US009181647B2

(12) United States Patent
Eglmeier et al.

(10) Patent No.: US 9,181,647 B2
(45) Date of Patent: Nov. 10, 2015

(54) WATER-CONDUCTING DOMESTIC APPLIANCE COMPRISING A TREATMENT REGION WHICH CAN BE VENTILATED

(75) Inventors: Hans Eglmeier, Berlin (DE); Andreas Hanau, Berlin (DE); Hartmut Schaub, Brieselang (DE)

(73) Assignee: BSH HAUSGERÄTE GMBH, Munich (DE)

( * ) Notice: Subject to any disclaimer, the term of this patent is extended or adjusted under 35 U.S.C. 154(b) by 353 days.

(21) Appl. No.: 13/814,515

(22) PCT Filed: Aug. 9, 2011

(86) PCT No.: PCT/EP2011/063674

§ 371 (c)(1), (2), (4) Date: Feb. 6, 2013

(87) PCT Pub. No.: WO2012/025370

PCT Pub. Date: Mar. 1, 2012

(65) Prior Publication Data

US 2013/0139556 A1 Jun. 6, 2013

(30) Foreign Application Priority Data

Aug. 24, 2010 (DE) ..... 10 2010 039 688

(51) Int. Cl.
*D06F 29/00* (2006.01)
*D06F 37/42* (2006.01)
(Continued)

(52) U.S. Cl.
CPC ..... *D06F 29/00* (2013.01); *D06F 37/267* (2013.01); *D06F 37/42* (2013.01); *D06F 39/12* (2013.01); *D06F 39/14* (2013.01)

(58) Field of Classification Search
CPC ..... D06F 29/00; D06F 37/42; D06F 37/267; D06F 39/12; D06F 39/14; A47L 15/0049; A47L 15/4259; A47L 2501/22
See application file for complete search history.

(56) References Cited

U.S. PATENT DOCUMENTS 6,000,248 A 12/1999 Erickson et al.
8,123,312 B2 2/2012 Jeon et al.
(Continued)

FOREIGN PATENT DOCUMENTS

CN 2619962 Y 6/2004
CN 1699668 A 11/2005
(Continued)

OTHER PUBLICATIONS

International Search Report PCT/EP2011/063674 dated Jan. 27, 2012.
(Continued)

*Primary Examiner* — Joseph L Perrin
(74) *Attorney, Agent, or Firm* — Nixon & Vanderhye P.C.

(57) ABSTRACT

A water-conducting domestic appliance includes a housing having an interior, and a door which is connected to the housing to provide access to a treatment region in the interior of the housing. A ventilation valve controls ventilation of the treatment region of the housing. A door closure is provided to close the door and has an actuator which is connected to the ventilation valve. The door closure is actively connected to the ventilation valve in such a manner that the actuator opens the ventilation valve when the door is released and closes the ventilation valve when the door is closed, so that the ventilation valve is closed when the door is closed during operation.

19 Claims, 2 Drawing Sheets

(51) Int. Cl.

| | |
|---|---|
| ***D06F 39/14*** | (2006.01) |
| ***D06F 37/26*** | (2006.01) |
| ***D06F 39/12*** | (2006.01) |

(56) References Cited

U.S. PATENT DOCUMENTS

| | | | | |
|---|---|---|---|---|
| 2002/0073744 | A1 | 6/2002 | Bollmann | |
| 2004/0163422 | A1* | 8/2004 | Kim et al. | 68/12.05 |
| 2004/0163684 | A1* | 8/2004 | Hapke | 134/57 DL |
| 2004/0194514 | A1 | 10/2004 | No et al. | |
| 2005/0011234 | A1* | 1/2005 | Kim et al. | 68/23 R |
| 2007/0017257 | A1* | 1/2007 | Bolduan et al. | 68/3 R |
| 2008/0078210 | A1 | 4/2008 | Kim et al. | |
| 2008/0190467 | A1* | 8/2008 | Maunsell et al. | 134/58 DL |
| 2009/0229315 | A1 | 9/2009 | Yoo et al. | |
| 2011/0296879 | A1 | 12/2011 | Seo et al. | |

FOREIGN PATENT DOCUMENTS

| | | | |
|---|---|---|---|
| DE | 4222736 | A1 | 1/1994 |
| EP | 0239012 | B1 | 5/1990 |
| FR | 2 933 599 | A1 | 1/2010 |
| KR | 10-2006-0013834 | A | 2/2006 |

OTHER PUBLICATIONS

National Search Report DE 10 2010 039 688.5 dated Jun. 7, 2011.

* cited by examiner

WATER-CONDUCTING DOMESTIC APPLIANCE COMPRISING A TREATMENT REGION WHICH CAN BE VENTILATED

This application is a U.S. National Phase of International Application No. PCT/EP2011/063674, filed Aug. 9, 2011, which designates the U.S. and claims priority to German Application No. 102010039688.5, filed Aug. 24, 2010, the entire contents of each are hereby incorporated by reference.

BACKGROUND OF THE INVENTION

The invention relates to a water-conducting domestic appliance, in particular a laundry treatment appliance for washing and/or drying laundry, having a housing, a door connected to the housing, by way of which a treatment region in the interior of the housing can be accessed, a door closure, which serves to close the door, and a ventilation valve, which serves to control ventilation of the treatment region. The invention relates specifically to the field of washing machines, tumble dryers and washer-dryers.

Such an appliance is disclosed in DE 44 22 736 A1. With this known domestic appliance, which is configured as a washing machine, a tub with a ventilation channel is provided, the ventilation channel being configured with a closing apparatus, which only opens when an underpressure occurs in the tub.

A domestic appliance in the form of a dishwasher is disclosed in EP 0 239 012 A1. This has, inter alia, a venting channel, to which a check valve is assigned, which can be controlled to an open position or a locking position according to the program.

A door arrangement for a washing machine is known from DE 10 2009 004 422 A1, which prevents a tub being closed when the washing machine is not in operation. The prior art assumes here that the user often keeps the door of the washing machine in a closed state when the laundry operation has been completed. If the door remains closed, even when the washing machine is not in use, harmful mold or similar can start to form in the tub due to the water remaining in the tub. Therefore with the known washing machine the door is kept in an open state when the washing machine is not in use to prevent harmful mold or similar starting to form in a tub. For this purpose the door arrangement has a hook hole to maintain a closed door state, a door with a hook shank to be positioned in the hook hole and a holding mechanism between the hook hole and the hook shank to hold the door in a state in which the door is open with a predefined gap. The holding mechanism has a first holding mechanism to engage with the door and a second holding mechanism to engage with the hook hole. The second holding mechanism here can have a hook part with an identical form to the hook shank. If the user closes the door in a state in which the holding mechanism holds the hook shank, the hook part is positioned in the hook hole in the housing with the result that the door is fastened to the housing. It is also possible for the holding mechanism to have a second holding mechanism with a magnetic part. If the user closes the door in a state in which the holding mechanism holds the hook shank, the magnetic part holds the metal housing by magnetic force, with the result that the door is held by the housing. This means that the door and housing are held at a predefined distance from one another, so that ventilation is ensured through the gap between the door and the housing.

The door arrangement known from DE 10 2009 004 422 A1 for a washing machine has the disadvantage that the user has to position the holding mechanism on the hook shank of the washing machine after washing. Only when the holding mechanism is positioned between the door and the housing does the now only partially possible closure of the door mean that ventilation is ensured through the gap between the door and the housing. However this is complex for the user. The user will therefore sometimes not position the holding mechanism. Also the user may forget to position the holding mechanism.

BRIEF SUMMARY OF THE INVENTION

The object of the invention is to create a water-conducting domestic appliance, with which the necessary ventilation of the treatment region is improved.

This object is achieved by a water-conducting domestic appliance, in particular a laundry treatment appliance for washing and/or drying laundry, according to the independent claim. The measures set out in the dependent claims allow advantageous developments of the inventive water-conducting domestic appliance.

The object is therefore achieved by a water-conducting domestic appliance, in particular a laundry treatment appliance for washing and/or drying laundry, having a housing, a door connected to the housing, by way of which a treatment region in the interior of the housing can be accessed, a door closure, which serves to close the door, a controller and a ventilation valve, which serves to control ventilation of the treatment region. According to the invention the door closure also has an actuator, which is connected to the ventilation valve and the door closure is actively connected to the ventilation valve in such a manner that the actuator opens the ventilation valve when the door is released and closes the ventilation valve when the door is closed, so that the ventilation valve is closed when the door is closed during operation.

Ventilation of the treatment region can advantageously be achieved by the ventilation valve when the water-conducting domestic appliance is not in operation. For example a living being could get into the treatment region, in particular a drum. If the door of the water-conducting domestic appliance is then inadvertently closed, there is a risk that the living being, which is then enclosed, might suffocate. According to the invention the ventilation valve allows adequate ventilation and air removal for breathing to be achieved.

At the same time closure can be achieved by way of the ventilation valve during operation, to secure the treatment region against exiting or entering media, such as gases, vapors, foam and air. It is also possible to prevent the egress of unpleasant, harmful or even poisonous working gases, for example ozone. It is thus possible to ensure adequate ventilation when the domestic appliance is not in operation and also safe closure of said ventilation during operation of the domestic appliance, in each instance by corresponding active actuation of the ventilation valve.

According to the invention the door closure is actively connected to the ventilation valve, in such a manner that the actuator opens the ventilation valve when the door is released and closes the ventilation valve when the door is closed. Such a door closure allows a ventilation opening or the like to be closed by the ventilation valve at the same time as the door is locked. When the domestic appliance is not in operation ventilation is ensured, with ventilation being interrupted during operation when the door is locked. It is thus advantageously possible to lock the door and actuate the ventilation valve by means of a single actuator. For example an electromagnetic actuator can actuate a slide, which in one end position locks the door and in the other end position keeps the door unlocked. The ventilation valve is then closed or opened synchronously by way of the active connection.

It is advantageous for the ventilation valve to have a first diaphragm and at least one second diaphragm, for the first and second diaphragm to rest on one another and for the actuator of the door closure to serve to displace the second diaphragm relative to the first diaphragm. The two diaphragms here can have suitable openings, which are interrupted by stays. The relative movement allows a large overall cross section to be achieved on opening. This means that the ventilation valve is embodied as an emergency breathing valve.

It is also advantageous for the ventilation valve to have at least one positionally fixed diaphragm, which is connected at least indirectly to the housing, and at least one movable diaphragm, for the positionally fixed diaphragm and the movable diaphragm to rest on one another and for the actuator of the door closure to be connected to the movable diaphragm.

For example the movable diaphragm can be displaced by an actuator of the door closure at the same time as a slide, which serves to lock the door. It is further advantageous here that the diaphragms form a sliding fin system or rotary fin system. In the case of a sliding fin system one diaphragm can be disposed in a positionally fixed manner while the other diaphragm can be displaced in a straight line. The diaphragms here can have rectangular openings, between which webs are provided. When the ventilation valve is in an opened position, the openings of the diaphragms lie in mutually assigned positions, in other words opposite one another. This means that the sum of all the openings gives a large overall cross section for the passage of air. On the other hand, when the ventilation valve is in the closed position, the openings and webs of the diaphragms lie in mutually assigned positions. This means that all the openings are closed, thereby blocking the passage of air. In the case of a rotary fin system one diaphragm can be disposed in a positionally fixed manner while the other diaphragm is disposed rotatably. The rotatable diaphragm can have the form of a propeller for example. The openings provided in the positionally fixed diaphragm can then be closed or opened as a function of the rotational position. However other embodiments can also be provided. For example the ventilation valve can be formed by folding fins. In this instance the ventilation valve can be formed by a set of synchronously moving folding fins disposed one above the other, which allow a passage of air in the folded position and block the passage of air in the not-folded position. In some instances the ventilation valve can also have just one or individual folding fins.

The door closure is advantageously coupled to the ventilation valve by way of a mechanical coupling element. This allows the two assemblies, namely the door closure and the ventilation valve, also to be disposed a long way from one another and/or with any alignment to one another. The mechanical coupling element here can have a deflection lever and/or a Bowden cable and/or push and pull rod systems, including hydraulic or pneumatic embodiments, and/or at least one pulling element, in particular a pulling rope, which can be provided with a spring as a countermeasure. Suitable combinations of the coupling elements are also possible, for example a rod system can be combined with deflection levers.

It is further advantageous for the door closure to have a bistable fixing mechanism, which holds a slide of the door closure either in a released position, in which the door is released, or in a blocked position, in which the door is closed, and for the ventilation valve to be held either in an opened position or in a closed position by way of the bistable fixing mechanism. The bistable fixing mechanism allows the ventilation valve to be held in the last-used position. A pulse from the actuator of the door closure moves the door closure and thus also the ventilation valve to the respectively opposite position, with the bistable fixing mechanism holding them there until the next pulse. The current position of the door closure, in particular a slide of the door closure, which releases or blocks the door, can be transmitted by way of a switching contact to a controller of the domestic appliance. For safety reasons the working contact of the switching contact is preferably selected in the locked position here.

With the embodiment of the domestic appliance it is also possible for the door closure to have an actuator and for a further actuator to be provided, which serves to actuate the ventilation valve. A functionality of the actuator of the door closure and a functionality of the further actuator are coupled here by way of a safety circuit. This allows the ventilation valve to be activated using a mechanically separated actuator. Depending on the embodiment the two actuators can be connected for example in series or parallel. In the case of electromagnetic actuators for example, if a coil of an actuator fails, the function of the respective other coil can also be canceled. If the ventilation valve is activated using its own actuator, which is essentially independent of the door closure, the ventilation valve can also have status feedback to a controller of the domestic appliance. For example a switching contact can be provided for an opened position of the ventilation valve. The two assemblies, namely the door closure and the ventilation valve, can advantageously be connected electrically together for the purpose of synchronization. Provision can be made for example for a crossover connection of the coil of the one actuator to the safety contact on the other assembly. A series connection of the switching contacts of both assemblies is also possible, so that the domestic appliance only starts up when the two safety contacts are in the desired positions.

BRIEF DESCRIPTION OF THE DRAWINGS

Preferred exemplary embodiments of the invention are described in more detail in the description which follows based the figures in the accompanying drawing, in which corresponding elements are shown with matching reference characters. In the drawing.

DETAILED DESCRIPTION OF EXEMPLARY EMBODIMENTS OF THE PRESENT INVENTION

Figure 1:
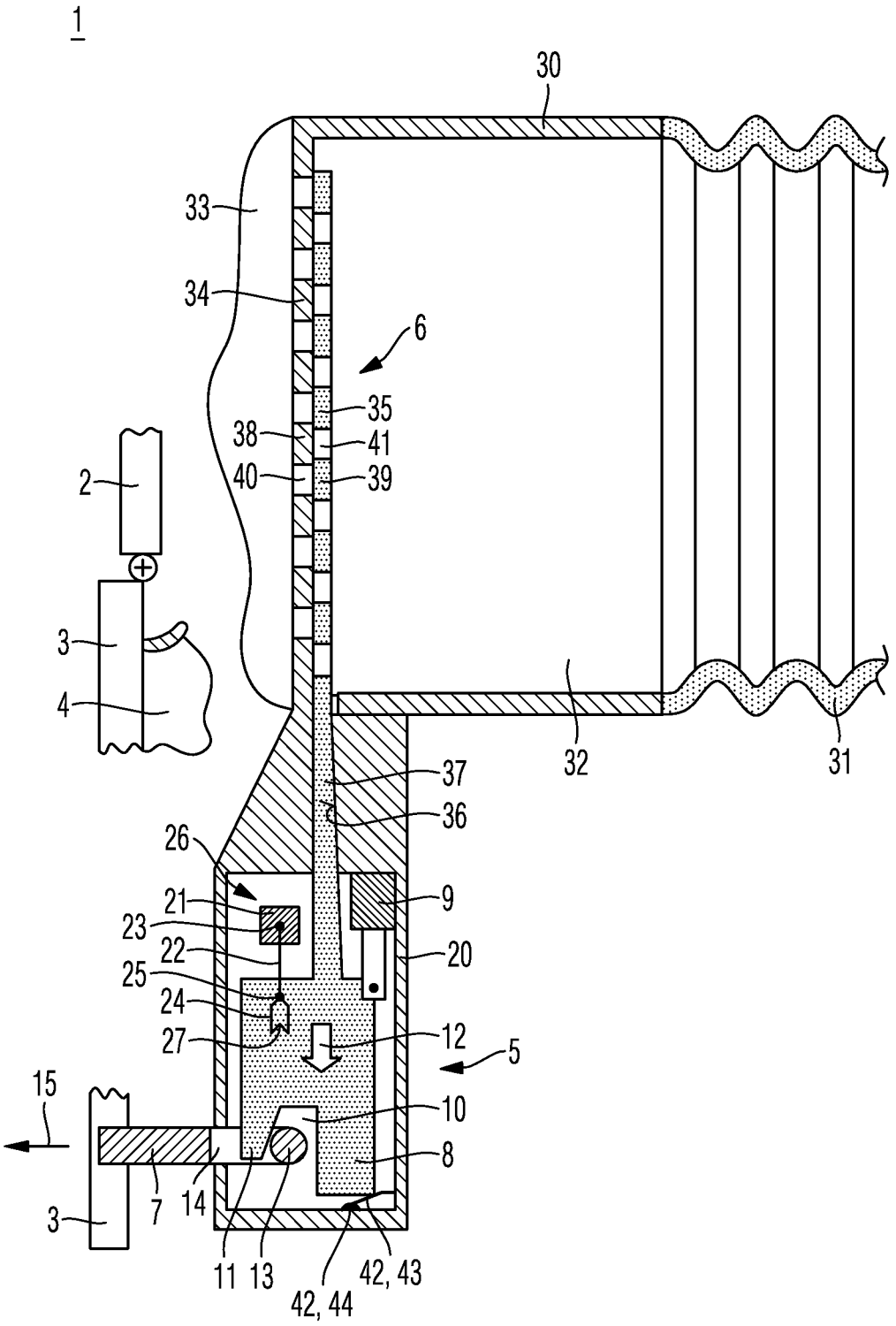
FIG. 1 shows a cut-out, schematic sectional diagram of a water-conducting domestic appliance according to a first exemplary embodiment

FIG. 1 shows a cut-out schematic diagram of a water-conducting domestic appliance 1 according to a first exemplary embodiment of the invention. The domestic appliance 1 can be embodied in particular as a laundry treatment appliance and can serve to wash and/or dry laundry. The domestic appliance 1 can specifically be embodied as a washing machine, washer/dryer or tumble dryer. The water-conducting domestic appliance 1 of the invention is however also suitable for other applications, in particular it can be embodied as a dishwasher.

The domestic appliance 1 has a housing 2, a door 3 connected to the housing 2, by way of which a treatment region 4 in the interior of the housing 2 can be accessed, and a door closure 5, which serves to close the door 3. The domestic appliance 1 also has a ventilation valve 6. The ventilation valve 6 serves to control ventilation of the treatment region 4.

The ventilation valve 6 closes off an exchange of air between the treatment region and 4 and its surroundings during laundry treatment. The ventilation valve 6 is activated here by way of the door closure 5.

The ventilation valve 6 ensures that adequate ventilation of the treatment region 4 is ensured for breathing for an enclosed living being. The ventilation valve 6 can be disposed at a suitable point. Relevant cross sections of the inlet hoses and/or the seal flushing system and/or a dispenser tray and/or other openings in the domestic appliance 1 are embodied with the required cross sections for this purpose.

The door closure 5 is illustrated schematically and serves for example to release or block a closure element 7, which can be embodied as a door lock 7. The door lock 7 can be positioned on the door 3 for example. The door closure 5 also has a slide 8, which can be actuated by way of an electromagnetic actuator 9. In this exemplary embodiment the slide 8 has a cutout 10, with the result that a projection 11 is embodied on the slide 8. When the slide 8 is actuated in a direction 12, the projection 11 engages in a free space 14 in the door lock 7 behind a stirrup 13 of the door lock 7. The stirrup 13 of the door lock 7 is then located in the cutout 10. This blocks movement of the door lock 7 in an opening direction 15. The closure element 7, in other words the door lock 7, is then in a blocked position. The door 3 cannot be opened in this position.

During operation when the program starts a controller can actuate the electromagnetic actuator 9, to displace the door closure 5 to the blocked position, thereby preventing the door 3 being opened during the treatment. At the end of the treatment, in other words when the treatment program has finished, the electromagnetic actuator 9 returns the slide 8 along the direction 12 to its original position, in which there is a released position for the door lock 7. This allows the door lock 7 to be displaced to the opening position 15, so the door 3 can be opened again.

The door closure 5 has a door closure housing 20. The electromagnetic actuator 9 is disposed in a positionally fixed manner in the door closure housing 20 and connected thereto. A stay 21 connected to the door closure housing 20 is also provided. Fastened to the stay 21 is a connecting element 22, one end 23 of the connecting element 21 being positioned at least rotatably on the stay 21. A closed curve 24 is also embodied in the slide 8. One end 25 of the connecting element 22 engages in the closed curve 24. In this embodiment the connecting element 22 is embodied as a connecting stirrup 22. The closed curve 24 is embodied as a cardioid 24. The connecting stirrup 22 and the cardioid 24 allow a bistable fixing mechanism 26 to be achieved. This bistable fixing mechanism 26 has two stable positions, in which it fixes the slide 8 in position. One stable position is the released position of the door closure 5. The other stable position is the blocked position of the door closure 5. FIG. 1 shows the blocked position. The released position is taken up when the connecting stirrup 22 is in the position 27 of the cardioid 24.

In this exemplary embodiment the end 25 of the connecting stirrup 22 is guided along the contour of a heart shape. The stable positions of the bistable fixing mechanism 26 are present at the two peaks of the heart shape. However other embodiments of the closed curve 24 are also possible, which have two stable positions, to achieve the bistable fixing mechanism 26.

The domestic appliance 1 has a container 30, which, according to the embodiment of the domestic appliance 1, is connected to a tub or the like or can itself even be embodied as a tub or the like. For example the container 30 can be connected to a tub by way of a bellows connection 31. An interior 32 of the container 30 is connected to the treatment region 4. The interior 32 here can also be part of the treatment chamber 4.

A connection between the interior 32 and its surroundings 33 is possible at least indirectly by way of the ventilation valve 6. When the ventilation valve 6 is open, in other words when the ventilation valve 6 is in an opened position, the interior 32 and therefore also the treatment region 4 are ventilated from their surroundings 33. When the ventilation valve 6 is in a closed position, the interior 32 is separated from its surroundings 33, so that the treatment region 4 is isolated from its surroundings 33. Treatment of laundry or the like can then be performed in the treatment region 4 without gases, foam, vapors and the like getting into the surroundings 33.

In this exemplary embodiment the ventilation valve 6 has a first, positionally fixed diaphragm 34 and a second, movable diaphragm 35. The diaphragm 34 is connected at least indirectly to the housing 2. In this exemplary embodiment the diaphragm 34 is connected to the housing 2 by way of the container 30 suspended in the housing 2. The door closure housing 20 is also connected to the container 30. The door closure housing 20 has a guide 36, in which a mechanical coupling element 37 embodied as a push and pull rod system 37 is guided. The rod system 37 connects the movable diaphragm 35 to the slide 8.

The diaphragms 34, 35 rest on one another. The diaphragms 34, 35 here are embodied as grid-type diaphragms 34, 35. Each of the diaphragms 34, 35 has webs 38, 39 and openings 40, 41, with only the webs 38, 39 and the openings 40, 41 shown here to simplify the diagram. When the ventilation valve 6 is in the closed position, as illustrated in FIG. 1, the openings 40, 41 and the webs 38, 39 lie in mutually assigned positions. As a result the web 38 blocks the opening 41 from the surroundings 33. The web 39 blocks the opening 40 from the interior 32.

When the ventilation valve 6 is in an opened position, the openings 40, 41 lie in mutually assigned positions. One of the connections between the surroundings 33 and the interior 32 is then embodied by way of the openings 40, 41. The sum of the openings gives a large overall cross section for the passage of air.

The size of the openings 40, 41 of the diaphragms 34, 35 is selected so that all the openings 40, 41 of the two diaphragms 34, 35 lie once in the same position in the two positions offset relative to one another around the lift of the slide 8, thereby giving a large overall cross section in total for the passage of air and the openings 40 of the diaphragm 34 come to rest on the webs 39 of the diaphragm 35 and vice versa in the opposing slide position, so that there is no free opening overall.

The actuator 9 of the door closure 5 is connected by way of the slide 8 and the mechanical coupling element 37 to the movable diaphragm 35. When the slide 8 is actuated, there is therefore an identically aligned and identically sized movement of the movable diaphragm 35. Depending on the embodiment of the mechanical coupling element 37 however a differently aligned movement of the slide 8 and the movable diaphragm 35 as well as a lift translation can also be achieved. For example a deflection lever, a Bowden cable or a combination of coupling elements, for example a rod system with deflection levers, can be used.

The door closure 5 has a button 42 with a spring element 43 and a contact 44. When the door closure 5 is in the blocked position, a power circuit is closed by way of the button 42, so that a controller of the water-conducting domestic appliance 1 detects that the door 3 is locked. At the same time information is given about the position of the ventilation valve 6. When the door closure 5 is in the blocked position, the ventilation valve 6 is in the closed position. However when the door closure 5 is in the released position, the ventilation valve 6 is in the opened position.

When the door 3 is released for example, a living being can get into the treatment region 4. The door 3 may then be closed inadvertently. However the door 3 here is then released, as the actuator 9 keeps the slide 8 in the released position when no program is running. This can be achieved by means of a spring element for example. Thus the ventilation valve 6 is also always in the opened position so that ventilation of the treatment region 4 is ensured and there is adequate ventilation to ensure that the enclosed living being can breathe.

In this exemplary embodiment the components of the ventilation valve 6, in particular the diaphragms 34, 35, with the associated guide 36 and the rod system 37 as well as any necessary sealing elements, are embodied as an integrated unit with the door closure 5. However a different separated embodiment is also possible, for example when a Bowden cable is provided.

In this exemplary embodiment the diaphragms 34, 35 of the ventilation valve 6 form a sliding fin system 34, 35. The movable diaphragm 35 here is displaced in a straight line relative to the positionally fixed diaphragm 34.

Figure 2:
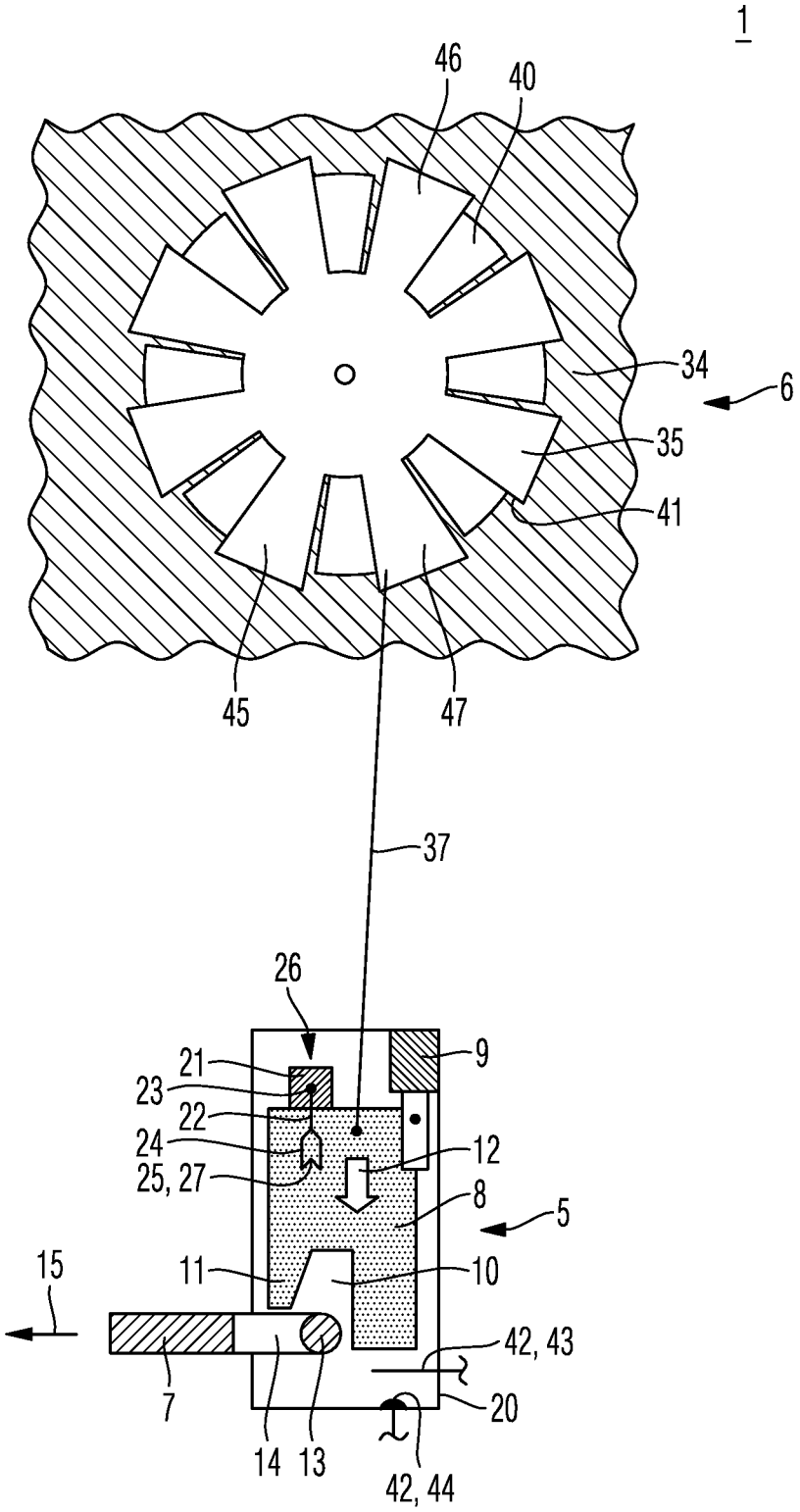
FIG. 2 shows a cut-out, schematic sectional diagram of a water-conducting domestic appliance according to a second exemplary embodiment.

FIG. 2 shows a cut-out, schematic sectional diagram of a water-conducting domestic appliance 1 according to a second exemplary embodiment. In this exemplary embodiment the positionally fixed diaphragm 34 has openings 40, which are disposed in a distributed manner in the peripheral direction in relation to an axis 45 of the ventilation valve 6. The movable diaphragm 35 is embodied in the manner of a propeller and has a number of blades 46, 47 corresponding to the number of openings 40, only the blades 46, 47 being shown, to simplify the diagram. In this exemplary embodiment the slide 8 is connected by way of the rod system 37 to the blade 47. There is also then a certain rotation of the movable diaphragm 35 about its axis 45 corresponding to the movement of the slide 8.

FIG. 2 shows the door closure 5 in a released position, in which the door lock 7 is released. The projection 11 of the slide 8 here is outside the free space 14 of the door lock 7. The end 25 of the connecting stirrup 22 of the bistable fixing mechanism 26 is also in position 27. This holds the slide 8 in the released position.

The movable diaphragm 35 is disposed in such a manner that an opened position of the ventilation valve 6 is achieved corresponding to the released position of the door closure 5. The blade 46 of the diaphragm 35 here is located next to the opening 40. This releases the opening 40. There is therefore an exchange of air by way of the ventilation valve 6.

When the slide 8 is actuated in the direction 12, the movable diaphragm 35 rotates, so that for example the blade 46 closes the opening 40. Webs provided between the openings 40 of the positionally fixed diaphragm 34 here line up with the free spaces between the blades 46, 47. This interrupts an exchange of air by way of the ventilation valve 6.

In this exemplary embodiment the mechanical coupling element 37 is embodied as an eccentric push and pull rod system 37. Any mechanical translation is possible here within certain limits. This means there is a correspondingly large degree of freedom in respect of the embodiment of the ventilation valve 6, in particular the diaphragms 34, 35. For example instead of the openings 40, 41 shaped in the manner of circle segments, spiral openings 40, 41, hole patterns or the like can be provided. Asymmetrical variants can also be implemented.

It is also possible for the ventilation valve 6 to be implemented by means of a mechanical closure in the form of an iris diaphragm, a folding fin or the like.

When the door lock 7 is released, the button 42 is also opened, so that the relevant power circuit is opened at the button 42. As a result a controller or the like of the water-conducting domestic appliance 1 also has information about the current status both of the door lock by means of the door closure 5 and also of ventilation by way of the ventilation valve 6.

In this exemplary embodiment the positionally fixed diaphragm 34 and the rotatable diaphragm 35 form a rotary fin system 34, 35.

With the embodiment of the domestic appliance 1 it is also possible to employ suitable activation by a controller or the like instead of a mechanical coupling between the door closure 5 and the ventilation valve 6. With this embodiment the second, movable diaphragm 35 can be actuated by way of a further actuator, which can be embodied according to the electromagnetic actuator 9. The two actuators 9 care coupled by way of a safety circuit here, so that when the door 3 is released, ventilation is achieved by way of the ventilation valve 6. This can be done by way of the controller, by providing suitable switching contacts. Also possible is a cross-over circuit or the like, in which the two actuators 9 are connected to one another according to their embodiment.

The invention claimed is:

1. A water-conducting domestic appliance, comprising:

a housing having an interior;

a door connected to the housing to provide access to a treatment region in the interior of the housing;

a ventilation valve for controlling ventilation of the treatment region; and a door closure configured to lock the door in a closed position and having an actuator which is connected to the ventilation valve, said door closure being actively connected to the ventilation valve in such a manner that the actuator opens the ventilation valve when the door is unlocked and closes the ventilation valve when the door is locked, so that the ventilation valve is closed when the door is closed during operation.

2. The domestic appliance of claim 1, constructed in the form of a laundry treatment appliance for washing and/or drying laundry.

3. The domestic appliance of claim 1, wherein the ventilation valve has a first diaphragm and at least one second diaphragm, with the first diaphragm and the second diaphragm resting on one another, said actuator of the door closure configured to displace the second diaphragm relative to the first diaphragm.

4. The domestic appliance of claim 3, wherein the first and second diaphragms form a sliding fin system or a rotary fin system.

5. The domestic appliance of claim 3, wherein the first and second diaphragms have openings and webs, said openings lying in mutually assigned positions, when the ventilation valve is in an opened position, and said openings and said webs lying in mutually assigned positions when the ventilation valve is in a closed position.

6. The domestic appliance of claim 1, wherein the ventilation valve has at least one positionally fixed diaphragm, which is connected at least indirectly to the housing, and at least one movable diaphragm, with the positionally fixed diaphragm and the movable diaphragm resting on one another, said actuator of the door closure being connected at least indirectly to the movable diaphragm.

7. The domestic appliance of claim 6, wherein the fixed and movable diaphragms form a sliding fin system or a rotary fin system.

8. The domestic appliance of claim 6, wherein the fixed and movable diaphragms have openings and webs, said openings lying in mutually assigned positions, when the ventilation valve is in an opened position, and said openings and said webs lying in mutually assigned positions when the ventilation valve is in a closed position.

9. The domestic appliance of claim 1, further comprising a mechanical coupling element coupling the door closure to the ventilation valve.

10. The domestic appliance of claim 1, wherein the door closure has a bistable fixing mechanism, which holds a slide of the door closure in a released position, in which the door is released, or in a blocked position, in which the door is closed, said ventilation valve being held in an opened position or in a closed position by way of the bistable fixing mechanism.

11. The domestic appliance of claim 1, wherein linear movement of the actuator causes a corresponding linear movement of the ventilation valve.

12. The domestic appliance of claim 11, wherein the actuator and the ventilation valve move in the same direction.

13. The domestic appliance of claim 1, wherein linear movement of the actuator causes a corresponding rotary movement of the ventilation valve.

14. A water-conducting domestic appliance, comprising:

a housing having an interior;

a door connected to the housing to provide access to a treatment region in the interior of the housing;

a ventilation valve for controlling ventilation of the treatment region; and a door closure configured to close the door and having an actuator which is connected to the ventilation valve, said door closure being actively connected to the ventilation valve in such a manner that the actuator opens the ventilation valve when the door is released and closes the ventilation valve when the door is closed, so that the ventilation valve is closed when the door is closed during operation, wherein the ventilation valve has at least one positionally fixed diaphragm, which is connected at least indirectly to the housing, and at least one movable diaphragm, with the positionally fixed diaphragm and the movable diaphragm resting on one another, said actuator of the door closure being connected at least indirectly to the movable diaphragm.

15. The domestic appliance of claim 14, wherein the fixed and movable diaphragms form a sliding fin system or a rotary fin system.

16. The domestic appliance of claim 14, wherein the fixed and movable diaphragms have openings and webs, said openings lying in mutually assigned positions, when the ventilation valve is in an opened position, and said openings and said webs lying in mutually assigned positions when the ventilation valve is in a closed position.

17. A water-conducting domestic appliance, comprising:

a housing having an interior;

a door connected to the housing to provide access to a treatment region in the interior of the housing;

a ventilation valve for controlling ventilation of the treatment region; and a door closure configured to close the door and having an actuator which is connected to the ventilation valve, said door closure being actively connected to the ventilation valve in such a manner that the actuator opens the ventilation valve when the door is released and closes the ventilation valve when the door is closed, so that the ventilation valve is closed when the door is closed during operation, wherein the ventilation valve has at least one positionally fixed diaphragm, which is connected at least indirectly to the housing, and at least one movable diaphragm, with the positionally fixed diaphragm and the movable diaphragm resting on one another, said actuator of the door closure being connected at least indirectly to the movable diaphragm.

18. The domestic appliance of claim 17, wherein the fixed and movable diaphragms form a sliding fin system or a rotary fin system.

19. The domestic appliance of claim 17, wherein the fixed and movable diaphragms have openings and webs, said openings lying in mutually assigned positions, when the ventilation valve is in an opened position, and said openings and said webs lying in mutually assigned positions when the ventilation valve is in a closed position.

* * * * *